US007665809B1

(12) United States Patent
Giles et al.

(10) Patent No.: US 7,665,809 B1
(45) Date of Patent: Feb. 23, 2010

(54) MIRRORED DRESSER STORAGE SYSTEM

(75) Inventors: Stephen Giles, High Point, NC (US); Dave Clark, Hickory, NC (US)

(73) Assignee: Universal Furniture International, Inc., High Point, NC (US)

( * ) Notice: Subject to any disclaimer, the term of this patent is extended or adjusted under 35 U.S.C. 154(b) by 0 days.

(21) Appl. No.: 11/781,698

(22) Filed: Jul. 23, 2007

(51) Int. Cl.
*A47B 17/04* (2006.01)

(52) U.S. Cl. ..... 312/204; 312/224

(58) Field of Classification Search ..... 312/204
See application file for complete search history.

(56) References Cited

U.S. PATENT DOCUMENTS

| | | | | | |
|---|---|---|---|---|---|
| 600,742 | A * | 3/1898 | Porter | ..... | 312/226 |
| 1,380,222 | A * | 5/1921 | Lichtenberg | ..... | 312/246 |
| 1,745,593 | A * | 2/1930 | Adams | ..... | 312/117 |
| D162,062 | S * | 2/1951 | Orsini | ..... | D6/441 |
| 2,937,911 | A * | 5/1960 | Steven | ..... | 312/312 |
| 4,088,380 | A * | 5/1978 | Watts | ..... | 312/237 |
| 4,854,656 | A | 8/1989 | O'Keefe | ..... | 312/345 |
| 5,066,079 | A * | 11/1991 | Lawrence | ..... | 312/204 |
| 5,127,719 | A | 7/1992 | Battista | ..... | 312/204 |
| 5,141,300 | A | 8/1992 | Ciesla | ..... | 312/204 |
| 5,590,940 | A * | 1/1997 | Richard | ..... | 312/287 |
| 5,681,100 | A | 10/1997 | Powell | ..... | 227/337 |
| 6,059,388 | A | 5/2000 | Wheatley, Jr. | ..... | 312/246 |
| 2005/0206279 | A1 * | 9/2005 | Lilly | ..... | 312/204 |

FOREIGN PATENT DOCUMENTS

| | | | | |
|---|---|---|---|---|
| EP | 316242 | * | 5/1989 | ..... 312/204 |

* cited by examiner

*Primary Examiner*—Hanh V Tran
(74) *Attorney, Agent, or Firm*—MacCord Mason PLLC

(57) ABSTRACT

A storage system for storing jewelry, etc., is shown and described. In one embodiment, the storage system includes a dresser. A mirrored member is fixedly mounted above the dresser. At least one vertically-oriented panel is slidably mounted to the mirrored member.

21 Claims, 4 Drawing Sheets

MIRRORED DRESSER STORAGE SYSTEM

BACKGROUND (1) Field

The present invention relates generally to mirrored dressers, and more particularly to mirrored dressers for jewelry storage. Even more particularly, the present invention relates to mirrored dressers having a slidable compartment for jewelry storage located behind the mirror.

(2) Related Technology

Traditional dressers are known in the art for clothes storage. At least one other has attempted to develop a mirrored dresser for jewelry storage. U.S. Pat. No. 5,127,719 ("Battista") discloses a concealed jewelry case in a dresser. Battista's dresser uses a pivoting mirror that pivots around a vertically oriented hinge. To gain access to Battista's hidden jewelry case, a user must lift the end of a spring biased pin located on the top panel of the mirror assembly. While possibly functional, Battista's dresser has various problems.

For example, when using Battista's dresser, a user must lift the spring biased pin, pivot the mirror open, and then close the mirror each time the user which to try on a new piece of jewelry in front of the mirror. Such repetition could become tedious if the user does not select the desired piece of jewelry on the first or second series of steps. Some may also consider such repetition to be a waste of time. Applicants' invention overcomes this problem by allowing users to access jewelry and view the mirror simultaneously, without the need for opening and closing doors or panels.

Further, Battista's dresser is potentially dangerous. The weight of mirrors is well known. Using Battista's design, the weight of the mirror is unstable and constantly shifting as the mirror swings with each opening, which could potentially topple the dresser onto those accessing the jewelry compartment or onto young children playing below. Because the dresser is heavy and because broken glass is sharp, such a result would be undesirable. In an attempt to avoid such an undesirable result, those using Battista's design would be limited by several constraints. The mirror's size and weight would be constrained by the size and weight of the dresser. For example, designers would need to ensure that the weight of Batista's mirror is within a range suitable to reduce the potential for dresser-topple as the mirror swings forward. Further, Batista's dresser and/or mirror assemble may need to be secured to floors or wall or both to reduce the chance of topple. Regardless of design optimization, users may still need to avoid swinging Batista's mirror open when dresser drawers are open, which could result in excessive forward weight and dresser topple. Applicants' invention addresses these problems by providing a stable and essentially stationary mirror that does not have the same size and weight constraints that Battista's mirror does. Applicants' invention also provides an improvement in safety.

U.S. Pat. No. 6,059,388 ("Wheatley") discloses a concealable jewelry box that is shown mounted behind a piece of furniture. Wheatly also discloses that Wheatly's jewelry box can be mounted behind a mirror. Wheatly's box, however, has numerous structural differences from the presently disclosed invention, which translate into various functional differences. By way of example, Wheatly's box is a box designed to stick to preexisting pieces of furniture. In terms of a mirror or dresser this is undesirable because Wheatly's box would prevent furniture from being flushly placed next to a vertical wall. Besides the aesthetic disadvantages of such a limitation, the spacing between furniture and wall would emphasize the positioning and location of valuable jewelry to those, e.g., burglars, searching for such items. Applicants' invention addresses these and additional problems.

SUMMARY

The present invention is directed to a storage system. In one embodiment, the storage system includes a dresser. A mirrored member is fixedly mounted above the dresser. At least one vertically-oriented panel is slidably mounted to the mirrored member.

In another embodiment, the storage system includes a mirrored member that is mounted at its bottom portion to an upper rear portion of the dresser. At least one slide is mounted to the bottom portion of the mirrored member. A first vertically-oriented panel is slidably mounted to the at least one slide. The first panel includes a first side panel perpendicularly attached thereto and a plurality of hooks configured to hold jewelry. A second vertically-oriented panel is slidably mounted to the at least one slide. The second panel includes a second side panel perpendicularly attached thereto and a plurality of hooks configured to hold jewelry. The first side panel and the second side panel are each configured to form compartments on opposite sides of the mirrored member, with the said first panel and the second panel being the rear-most walls of each compartment. The first side panel and the second side panel are configured to flushly align with the sides of the mirrored member with panels have been received by the mirrored member. The result is an appearance of continuity between the member and the panel, and a storage system with the ability to be substantially flushly placed adjacent to vertically oriented walls.

In another embodiment, the storage system includes a mirrored member having at least one vertically-oriented panel being slidably mounted to the mirrored member.

The above summary was intended to summarize certain embodiments of the present invention. Embodiments of the present invention will be set forth in more detail in the figures and detailed description below. It will be apparent, however, that the detailed description is not intended to limit the present invention, the scope of which should be properly determined by the appended claims.

DESCRIPTION OF THE PREFERRED EMBODIMENTS

Figure 1:
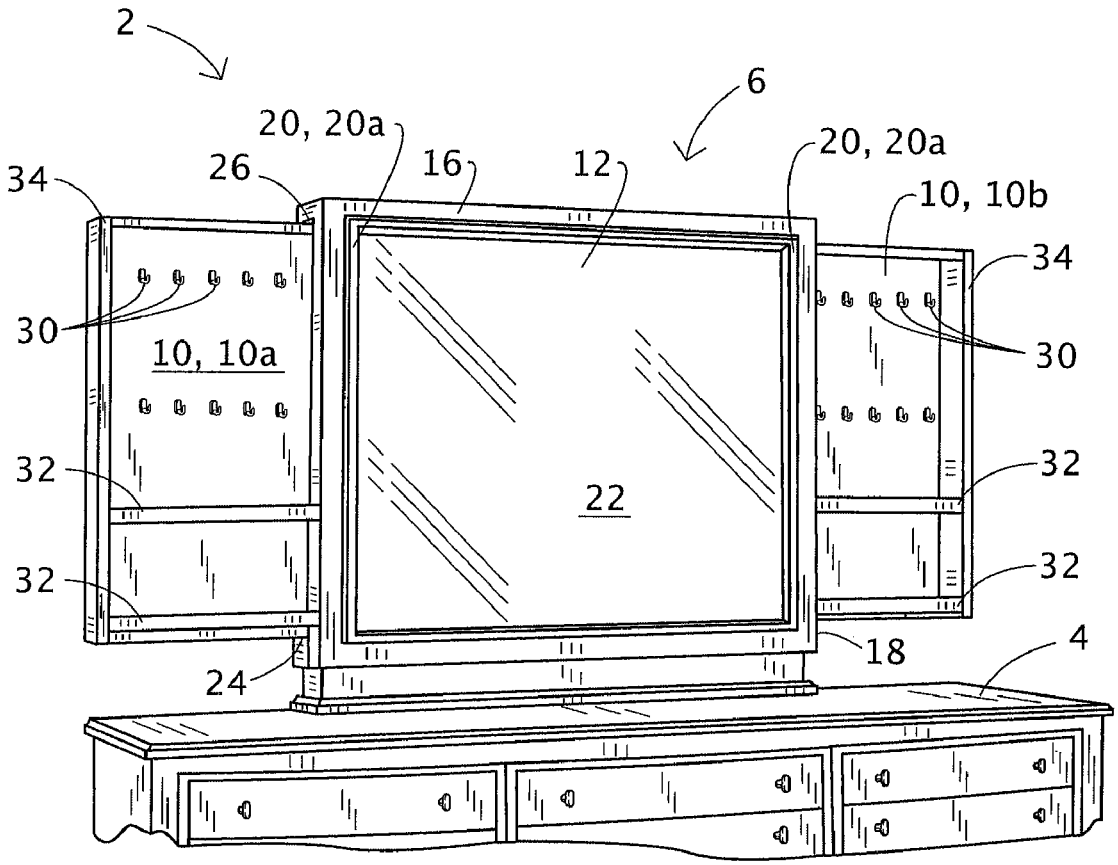
FIG. 1 is a perspective view of one embodiment of the storage system of the present invention, wherein the panels have been slide out of the mirrored member.

FIG. 1 shows one embodiment of storage system 2 of the present invention. Storage system 2 includes dresser 4, mirrored member 6, and at least one vertically-oriented panel 10 that is slidably mounted to member 6.

Mirrored member 6 includes a front 12, a back (not visible in this figure, but positioned opposite front 12), a top portion 16, a bottom portion 18, and a pair of sides 20*a* and 20*b*, and is preferably fixedly attached to dresser 4 near bottom portion 18. In other embodiments, however, member 6 may be placed above a dresser or used independently of a dresser. Mirror 22 is positioned on front 12 of member 6 and is preferably fixedly mounted to member 6 to reduce undesirable mirror movement.

In preferred embodiments, member 6 includes at least one slide 24 configured to engage panel 10. Slide 24 is preferably positioned on the back of member 6, and even more preferably, is positioned on the back of said member 6 near the bottom 18 of said member. Slides 24 may be any of the variety of slides known in the art, e.g., friction, roller, track, etc, with the engagement of panel 10 depending primarily on the type of slide used. For example, if slide 24 is a friction slide, engagement may be achieved by contact between the slide and one, two, or three sides of panel 10. In some embodiments, such as the one displayed in FIG. 1, slide 24 may be positioned along the complete width or essentially the complete width of member 6, thereby allowing a single slide structure to engage a pair of panels located on each side of member 6. In other embodiments, slides 24 may not be continuous, e.g. may be discontinuous toward the middle of member 6, or may only be on one side, and such embodiments are also considered to be inclusive of the present invention.

Member 6 will also preferably include downward facing channel 26 near top portion 16 of member 6. Downward facing channel 26 is configured to engage at least one panel 10, preferably a pair of panels 10 as shown, and allow panels 10 to travel substantially horizontally through channel 26.

Although embodiments of the present invention may be achieved with a single panel 10, applicants prefer, as shown, a first panel 10*a* and a second panel 10*b*. Panel 10 is preferably slidably mounted behind member 6, as shown, and in most embodiments, panel 10 and member 6 form a compartment with panel 10 being the rear-most wall of the compartment when panel 10 is received by member 6. A plurality of hooks 30 are positioned on the vertical surface of panel 10 to allow hooks 30 to engagably and releasable hold jewelry, e.g., necklaces, rings, watches, bracelets, anklets, etc. Hooks 30 are sized to allow panel 10 to slide into and out of member 6 without obstruction. Panel 10 also preferably includes at least one narrow, horizontally oriented tray 32, which is designed to be suitable for holding rings, earrings, watches, money, etc. Preferably, panel 10 includes two trays 32, but others may prefer more, and such embodiments are considered to be within the scope of the present invention.

Panel 10 includes side panel 34, which is, in preferred embodiments, substantially to essentially perpendicular to the vertical surface of panel 10. Side panel 34 is also preferably positioned at a distal portion of panel 10. Regardless of its exact orientation, side panel 34 is, in preferred embodiments, configured to flushly align with a side 20 of member 12 when panel 10 has been received by member 6. This flush alignment creates an appearance of continuity between panel 10 and member 6, which makes member 6 appear as a solid piece, thereby thwarting thieves.

Figure 2:
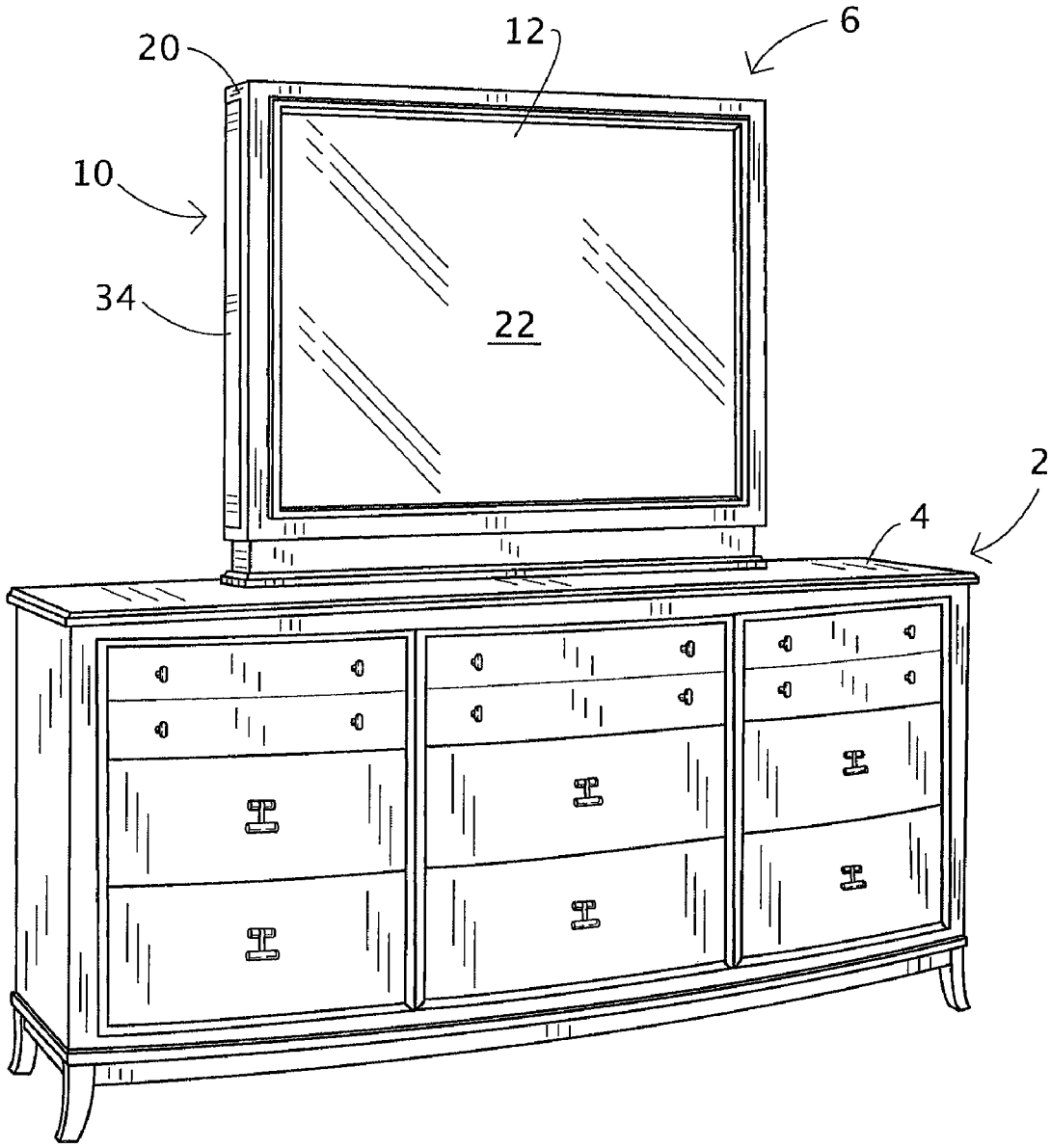
FIG. 2 is a perspective view of the embodiment of FIG. 1, wherein the panels have been received by the mirrored member.

FIG. 2 shows storage system 2 of FIG. 1 with panels 10 received by member 6, thereby forming a compartment for jewelry storage. As discussed above, side panel 34 of panel 10 is flushly aligned with sides 20 of member 6. If side panel 34 is recessed too far within member 6, or extends too far out of member 6, panel 10 may be readily observable, putting any contents contained therein at risk.

Figure 3:
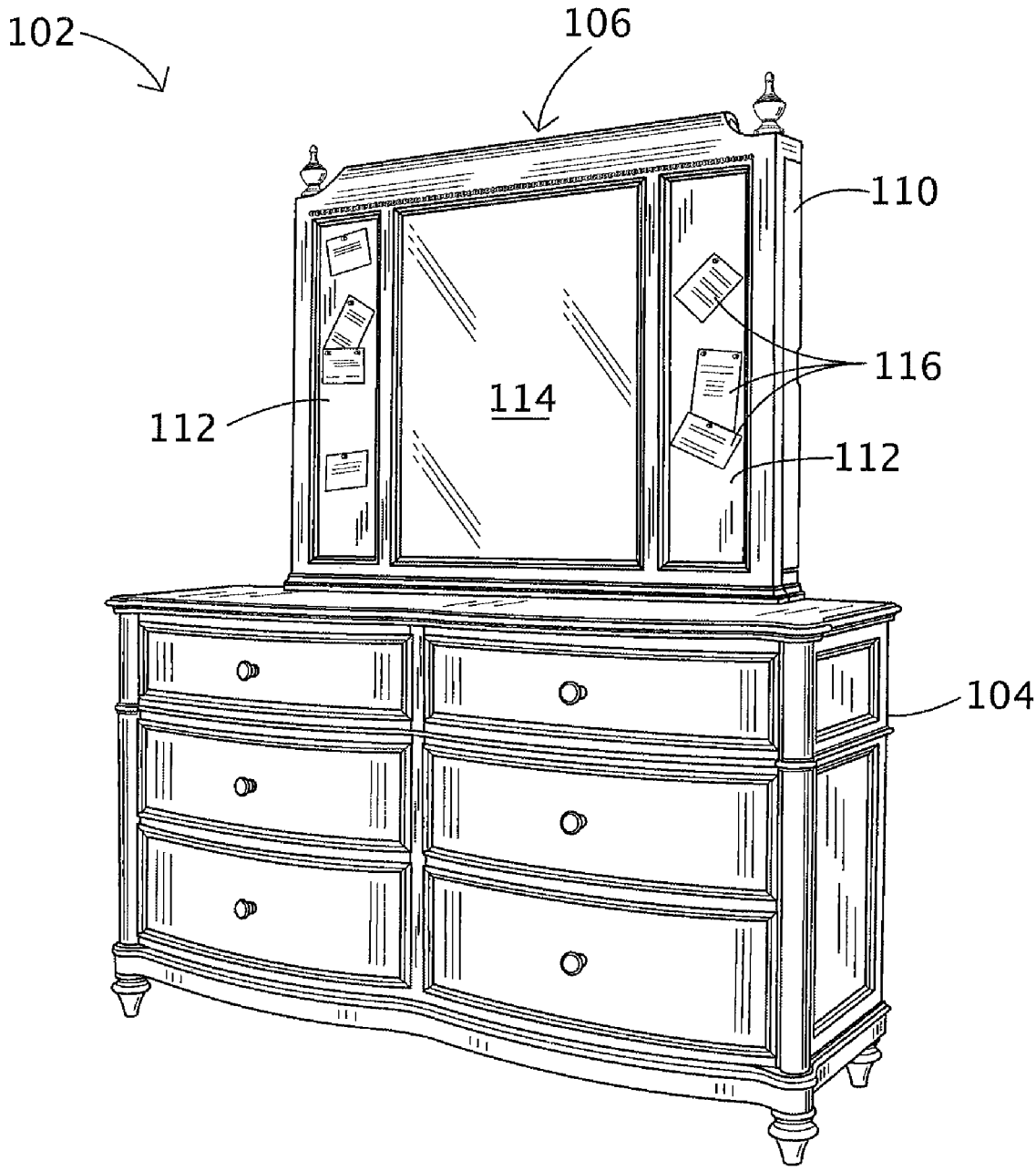
FIG. 3 is a perspective view of another embodiment of the storage system of the present invention including a communications surface adjacent to the mirror, wherein the panels have been received by the mirrored member.
Figure 4:
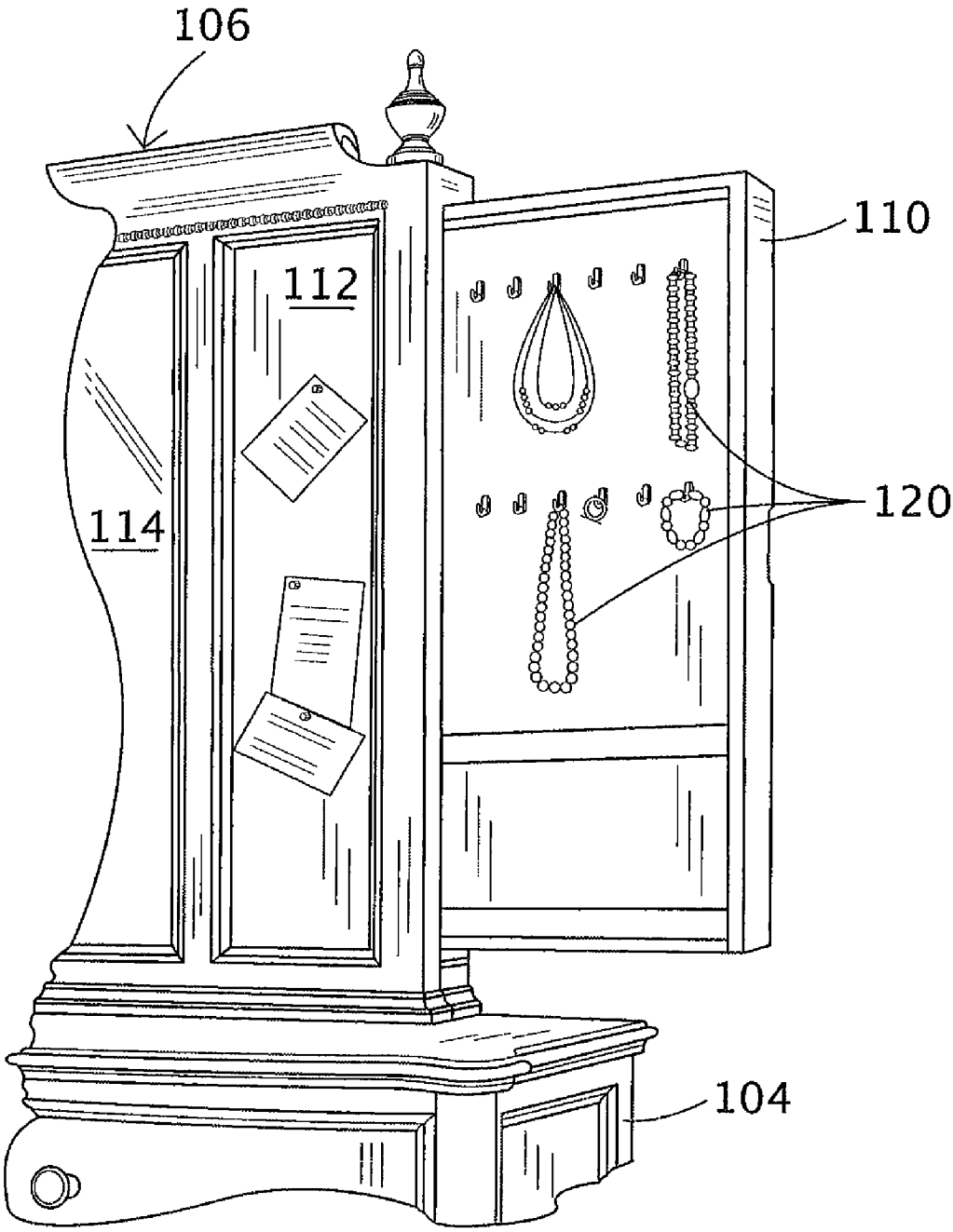
FIG. 4 is a perspective view of the embodiment shown in FIG. 3, wherein the panels have been slid out of the mirrored member and jewelry contained on hooks of the panel is visible.

FIG. 3 shows another embodiment of a storage system 102, according to the present invention. In this embodiment, system 102, similar to previously described and shown embodiments, includes dresser 104, mirrored member 106, and vertically-oriented panel 110, which is shown as flushly received by member 106. This embodiment also includes at least one, and preferably, as shown, two substantially vertically oriented communication surfaces 112 adjacent to mirror 114. Numerous communication surfaces could be used to achieve the present invention, but preferred embodiments will include cork board, dry erase board, chalk board, or combinations thereof. In the presently illustrated embodiment, communication surface 112 is cork board and contains various pieces of communications 116 (e.g., notes, cards, photographs, drawings, etc.) posted thereon. Communication surface 112 has a height substantially similar to the height of mirror 114, and even more preferably, has essentially the same height as mirror 114. As seen, communication surface 112 has a width of about $1/4^{th}$ the width of mirror 114, but preferred embodiments of the communication surface may also have a width of about $1/5^{th}$ to about $1/3^{rd}$ of the width of the mirror. FIG. 4 shows a close-up view of the system of FIG. 3. In this view, panel 110 has been slid out of member 106 to allow access to jewelry 120, similar to as described in previous embodiments.

As is illustrated by the various Figures and their accompanying descriptions, one using the present invention can easily hide, access, done, and view when donned multiple pieces of jewelry without the wasteful opening and closing of compartments as required by the related technology. Further, because the mirror of the present invention is fixedly mounted and does not swing forward relative to the dresser, the present invention provides a much safer solution to the aforementioned problems than the related technology. Further, using the teachings presently contained herein, the storage system, including the dresser and mirrored member, may be essentially flatly placed against a vertical wall, which, in addition to overcoming the visible gap created by jewelry boxes such as Wheatly discussed above, helps maximizes the space and aesthetic within a room.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed. It is further noted that, as used in this specification, the singular forms "a," "an," and "the" include plural referents unless expressly and unequivocally limited to one referent.

We claim:

1. A storage system comprising:

a dresser;

a mirrored member fixedly mounted above said dresser, said member having a front, a back, a top portion, a bottom portion, a pair of sides and a mirror non-movably mounted on said front; and at least one vertically-oriented panel slidably mounted to said member; and at least one side panel attached to said at least one vertically-oriented panel and configured to flushly align with a side of said member's sides when said vertically-oriented panel has been received by said member, wherein said side panel does not include a protruding handle on its surface, thereby creating an appearance of continuity between said member and said panel; wherein said at least one panel is slidably mounted behind said member, and wherein said member and said at least one vertically-oriented panel form at least one compartment, said at least one vertically-oriented panel being a rear-most wall of said at least one compartment and said mirrored member, and wherein said at least one vertically-oriented panel does not extend rearwardly of said top portion of said mirrored member.

2. The storage system of claim 1, wherein said mirrored member includes at least one slide, said slide configured to slidably engage said at least one vertically-oriented panel.

3. The storage system of claim 2, wherein said slide includes a portion mounted to said back of said member.

4. The storage system of claim 2, wherein said slide includes a first portion mounted near said bottom portion of said member.

5. The storage system of claim 2, wherein said member includes a downward facing channel near said top portion of said member, said channel being configured to engage said at least one panel and allow said at least one panel to travel therethrough.

6. The storage system of claim 1, wherein said at least one vertically-oriented panel includes a plurality of hooks attached to said panel's vertical face, said plurality of hooks being sized to allow said at least one panel to slide without obstruction and being positioned to engage necklaces and rings.

7. The storage system of claim 1, wherein said at least one vertically-oriented panel includes at least one narrow, horizontally oriented tray.

8. The storage system of claim 1, wherein said mirrored member further includes at least one substantially vertically oriented communication surface adjacent to said mirror on said front of said member.

9. The storage system of claim 8, wherein said communication surface has a height substantially similar to said mirror's height.

10. The storage system of claim 8, wherein said communication surface has a width about $1/5^{th}$ to about $1/3^{rd}$ of said mirror's width.

11. The storage system of claim 8, wherein said mirrored member includes a first vertically oriented communication surface on one side of said mirror and a second vertically oriented communications surface on an opposite side of said mirror.

12. The storage system of claim 8, wherein said communication surface is selected from the group consisting of dry erase board, chalk board, cork board, and combinations thereof.

13. The storage system of claim 11, wherein said first and second communications surfaces are cork boards, and wherein said first and second communications surfaces each have a height substantially similar to the height of said mirror and have a width about $1/5^{th}$ to about $1/3^{rd}$ of said mirror's width.

14. The storage system of claim 1, wherein said at least one vertically-oriented panel includes a first vertically-oriented panel slidably mounted behind one side of said member, said first panel including a first side panel; and a second vertically-oriented panel slidably mounted behind an opposite side of said member, said second panel including a second side panel, wherein said first side panel and said second side panel are configured to flushly align with said member's sides when said panels have been received by said member, thereby creating an appearance of continuity between said member and said panel.

15. The storage system of claim 1, wherein said dresser is configured to be essentially flatly placed against a vertical wall, thereby maximizing living space within a room.

16. A storage system comprising:

a dresser;

a mirrored member having a non-movably mounted mirror, a front, a back, a top portion, a bottom portion and a pair of sides, wherein said bottom portion of said member is fixedly-mounted to said dresser;

at least one slide mounted to said bottom portion of said member;

a first vertically-oriented panel slidably mounted to said at least one slide, said first panel including a first side panel perpendicularly attached thereto and said first panel including a plurality of hooks configured to hold jewelry;

a second vertically-oriented panel slidably mounted to at least one slide, said second panel including a second side panel perpendicularly attached thereto and said second panel including a plurality of hooks configured to hold jewelry;

wherein said first panel and said second panel form compartments on opposite sides of said member, said first panel and said second panel being the rear-most walls of said each compartment and said mirrored member; wherein said at least one vertically-oriented panel does not extend rearwardly of said top portion of said mirrored member wherein said first side panel and said second side panel are configured to flushly align with said member's sides when said panels have been received by said member, and wherein said first side panel and said second side panel do not include protruding handles, thereby creating an appearance of continuity between said member and said panel.

17. The storage system of claim 16, wherein said mirrored member includes a downward facing channel mounted near said top portion of said member, said channel being configured to engage said at least one panel and allow said at least one panel to travel therethrough.

18. The storage system of claim 16, wherein said first vertically-oriented panel and said second vertically-oriented panel each include at least one narrow, horizontally oriented tray.

19. The storage system of claim 16, wherein said mirrored member further includes at least one substantially vertically oriented communication surface adjacent to said mirror on said front of said member.

20. The storage system of claim 19, wherein said mirrored member includes a first vertically oriented communications surface on one side of said mirror, and a second vertically oriented communications surface on an opposite side of said mirror, wherein said first and second communications surfaces each have a height substantially similar to the height of said mirror and have a width about $1/5^{th}$ to about $1/3^{rd}$ of said mirror's width.

21. The storage system of claim 20, wherein said communications surface is selected from the group consisting of dry erase board, chalk board, cork board, and combinations thereof.

* * * * *

UNITED STATES PATENT AND TRADEMARK OFFICE

CERTIFICATE OF CORRECTION

PATENT NO. : 7,665,809 B1
APPLICATION NO. : 11/781698
DATED : February 23, 2010
INVENTOR(S) : Stephen Giles and Dave Clark It is certified that error appears in the above-identified patent and that said Letters Patent is hereby corrected as shown below:

In Column 2, Line 47, the word slide should be slid.

In Column 3, Line 66, after observable, the rest of the sentence should read "putting any contents contained therein at risk."

Signed and Sealed this

Thirtieth Day of March, 2010

David J. Kappos

David J. Kappos
*Director of the United States Patent and Trademark Office*